US006837479B2

(12) United States Patent
Symonds, Jr.

(10) Patent No.: US 6,837,479 B2
(45) Date of Patent: Jan. 4, 2005

(54) FLUID DRAIN ASSEMBLY

(75) Inventor: Robert D. Symonds, Jr., Toledo, OH (US)

(73) Assignee: Honeywell International Inc., Morristown, NJ (US)

( * ) Notice: Subject to any disclaimer, the term of this patent is extended or adjusted under 35 U.S.C. 154(b) by 142 days.

(21) Appl. No.: 10/228,117

(22) Filed: Aug. 26, 2002

(65) Prior Publication Data

US 2004/0036049 A1 Feb. 26, 2004

(51) Int. Cl.[7] ..... F16K 51/00

(52) U.S. Cl. ..... 251/149.5; 251/149.6; 184/1.5; 141/351; 141/384

(58) Field of Search ..... 251/149.4, 149.5, 251/149.6; 184/1.5; 141/351, 384

(56) References Cited

U.S. PATENT DOCUMENTS

| | | | | | |
|---|---|---|---|---|---|
| 4,150,809 | A | * | 4/1979 | Muller | 251/149.6 |
| 4,269,237 | A | | 5/1981 | Berger | 141/346 |
| 4,386,639 | A | | 6/1983 | Gable et al. | |
| 4,530,421 | A | * | 7/1985 | Balch | 251/149.6 |
| 4,574,586 | A | * | 3/1986 | Gabrysch | 251/57 |
| 4,709,722 | A | | 12/1987 | Knapp | 137/539 |
| 4,807,847 | A | | 2/1989 | Martz | 251/144 |
| 4,917,356 | A | | 4/1990 | Shirdavani | 251/294 |
| 4,940,209 | A | | 7/1990 | Fish | 251/144 |
| 5,048,578 | A | | 9/1991 | Dorf et al. | 141/346 |
| 5,299,777 | A | | 4/1994 | Milstead | 251/144 |
| 5,630,451 | A | | 5/1997 | Bernard | 141/10 |
| 5,667,195 | A | | 9/1997 | McCormick | 251/149.6 |
| 5,738,144 | A | * | 4/1998 | Rogers | 251/149.4 |
| 5,765,612 | A | * | 6/1998 | Morin | 141/384 |
| 5,975,164 | A | * | 11/1999 | Whaley et al. | 141/351 |
| 6,126,142 | A | | 10/2000 | Wolf et al. | 251/354 |
| 6,142,161 | A | | 11/2000 | Abbruzze | 134/169 |
| 6,199,578 | B1 | | 3/2001 | Clark, II | 137/318 |
| 6,314,989 | B1 | | 11/2001 | Fritz et al. | 137/449 |

FOREIGN PATENT DOCUMENTS

| | | |
|---|---|---|
| AU | 1414976 | 11/1977 |
| DE | 3921319 | 1/1991 |
| DE | G9207055 | 9/1992 |
| NL | 8602161 | 8/1986 |

OTHER PUBLICATIONS

"Waste Gard ll" brochure, Fluid Line Products, Inc., date unknown.

Copy of International Search Report of PCT/US03/26732.

* cited by examiner

*Primary Examiner*—John Bastianelli

(57) ABSTRACT

A fluid drain assembly having a valve member including a valve. The fluid drain assembly includes a conduit adapter member removably engageable with the valve member and in fluid communication therewith. A valve actuating member is disposed within the conduit adapter member. When the conduit adapter member is engaged with the valve member, the valve actuating member opens the valve, thereby creating a fluid path from the sump. When the conduit adapter member is disengaged from the valve member, the valve closes and substantially prevents fluid from flowing out of the sump.

41 Claims, 2 Drawing Sheets

FLUID DRAIN ASSEMBLY

BACKGROUND OF THE INVENTION

This invention relates generally to a fluid drain assembly, and more particularly to such an assembly useful for changing oil in automobiles.

Draining fluid from any kind of sump often becomes an awkward proposition, both from the standpoint of achieving effective drainage of the sump, and from the standpoint of preventing excessive cleaning after such drainage. This is particularly true with regard to oil from an internal combustion engine. Sump drainage also generally requires the use of tools which may be inconvenient to use.

One attempt at solving the above-mentioned problems includes replacing an oil pan drain plug with a valve body having a poppet valve. Attached to the valve body is either a dust cap having a gasket/seal therein; or, when draining is desired, an activation member having a hose attachment side, a valve body attachment side, and a triangularly shaped activation pin. The activation member has therein a gasket/seal. The activation member thus includes four separate components: a threaded coupling (valve body attachment side); the gasket/seal; a hose barb end form (the hose attachment side); and the activation pin. The threaded coupling and the hose barb end form are attached by swaging or another suitable manufacturing process.

There are several drawbacks associated with the above-mentioned design. The manufacturing step necessary to attach the threaded coupling to the hose barb end form adds additional expense, both in manufacture time and resources (human and/or materials). Further, the joint between the threaded coupling and the hose barb becomes a potential leak path for hot fluid. The gasket/seal proximate to the joint is an attempt to seal this potential leak path. Further, the triangular shaped activation pin requires the aperture in the valve seat to be large enough such that the triangular pin penetrates to a depth sufficient to open the poppet valve. This relatively large aperture in turn necessitates that the entire fluid drain assembly be larger. This also adds to the cost of manufacture. The relatively large size of the device may in certain instances prove to be a problem, particularly in the case of automobiles wherein the oil pan is one of the lower parts of the automobile underbody—if the valve body, with or without the dust cap installed, hits the road, rocks, or anything protruding upward from the surface of the road, the device may be pulled out of the oil pan or may be damaged. In either case, the potential exists for unwanted drainage of oil.

Thus, a need exists for an improved fluid drain assembly.

SUMMARY OF THE INVENTION

As may readily be appreciated, it would be desirable to provide a fluid drain assembly which is cost effective to manufacture and advantageously eliminates step(s) in the manufacturing process. Further, it would be desirable to provide such an assembly which advantageously reduces the potential for leaking. Still further, it would be desirable to provide such an assembly having a valve actuating member adapted to actuate the valve through a relatively small aperture in the valve seat. Yet further, it would be desirable to provide such an assembly which may be relatively small/compact if desired and/or necessary.

The present invention addresses and solves the drawbacks mentioned above, and substantially meets the abovenumerated desires, as well as others, by providing a fluid drain assembly for attachment to a fluid sump having a wall. The drain assembly comprises a valve member adjacent the sump wall, the valve member being in fluid communication with the sump. The valve member has a normally closed valve therein, and further has two opposed end regions, one end region adjacent the sump and an other end region distal from the sump. A seal member is disposed on the other end region.

The fluid drain assembly of the present invention further comprises a conduit adapter member removably engageable with the valve member and adapted to be in fluid communication therewith. The conduit adapter member comprises a valve member coupling portion engageable with the valve member other end region; and a conduit coupling portion opposed to the valve member coupling portion. The conduit coupling portion is adapted to have a conduit removably attached thereto. The two coupling portions are unitarily formed as a one piece structure. A valve actuating member is disposed within the valve member coupling portion.

When the conduit adapter member is engaged with the valve member, the conduit adapter member seals against the seal member, and the valve actuating member opens the valve, thereby creating a fluid path from the sump through the valve member and out the conduit adapter member. When the conduit adapter member is disengaged from the valve member, the valve closes and substantially prevents fluid from flowing out of the sump.

BRIEF DESCRIPTION OF THE DRAWINGS

Objects, features and advantages of the present invention will become apparent by reference to the following detailed description and drawings, in which.

DETAILED DESCRIPTION OF THE PREFERRED EMBODIMENTS

Figure 1A:
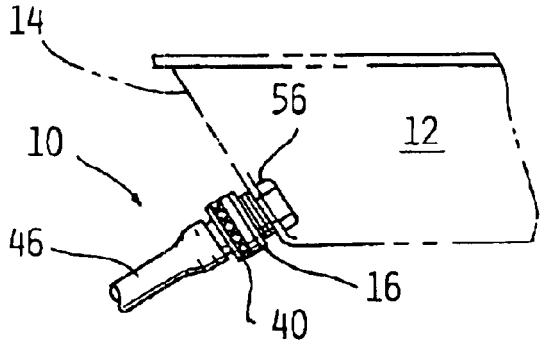
FIG. 1A is a cutaway side view of the present invention shown installed on a fluid sump (in phantom)

Referring now to FIG. 1A, the fluid drain assembly of the present invention is designated generally as 10. Fluid drain assembly 10 is shown attached to a fluid sump 12 having a wall 14 (the fluid sump 12 is shown in phantom). It is to be understood that the fluid drain assembly 10 of the present invention is not to be limited to any particular application(s), but rather may find use in a variety of applications involving fluid sumps which need the fluid drained therefrom. As non-limitative examples, the present invention may be used with any vehicle or structure having a transmission and/or an internal combustion engine with a fluid sump (eg. an oil sump), including, but not limited to motor vehicles (automobiles, trucks, SUVs and the like), watercraft, locomotive engines, oil rigs, etc. It is believed that the present invention may find particular use in the automotive market.

The fluid drain assembly 10 comprises a valve member 16 adjacent sump wall 14, valve member 16 being in fluid communication with sump 12. Valve member 16 has a normally closed valve 18 therein. Valve member 16 further has two opposed end regions, one end region 20 adjacent sump 12, and an other end region 22 distal from sump 12.

Figure 2:
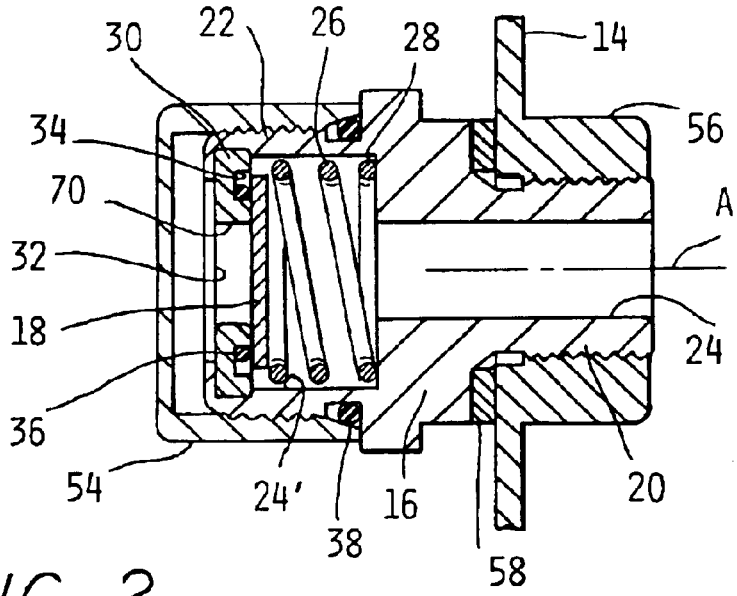
FIG. 2 is an enlarged cross-sectional view showing the valve member installed in the sump wall, with the dust cap attached to the valve member.

Valve member 16, as best seen in FIG. 2, further has a throughbore 24 extending longitudinally therethrough, the throughbore 24 adapted to be in fluid communication with the sump 12. It is to be understood that the one end region 20 and the other end region 22 may be configured in any suitable manner so as to suitably attach to the sump wall 14 and the dust cap 54 or the conduit adapter member 40 (described further below), respectively, by any suitable means. However, in the preferred embodiment, the one end region 20 and the other end region 22 both are externally threaded.

It is to be understood that throughout the present disclosure, wherever any type of threading engagement/threads are recited, disclosed, shown or suggested, the threads may be of any suitable type, size and/or pitch, and may be manufactured by any suitable method as desired and/or necessitated.

Throughbore 24 widens in the other end region 22 to form a widened throughbore 24'. A spring 26 is disposed within the widened throughbore 24'. A shoulder area 28 of the throughbore 24' defines a stop for the spring 26. Shoulder area 28 is located at about a transition area between the one end region 20 and the other end region 22. A valve seat 30 is disposed at an end 32 of the widened throughbore 24' opposed to the spring stop 28. The valve seat 30 has an O-ring groove 34 defined therein, and further has an aperture 70 defined therein. Although it is to be understood that aperture 70 may be of any suitable shape and size, in a preferred embodiment, aperture 70 is substantially circular and ranges in size between about 0.20 inch (5.1 mm) and about 0.30 inch (7.6 mm). In a further preferred embodiment, aperture 70 ranges in size between about 0.24 inch (6.1 mm) and about 0.26 inch (6.6 mm). In a more preferred embodiment, aperture 70 is about 0.25 inch (6.3 mm).

An O-ring/seal 36 is disposed within O-ring groove 34. It is to be understood that O-ring 36 may be one of O-rings, gaskets, seals, wiping seals, or any other suitable sealing device. It is to be understood that O-ring 36 may be formed from any suitable material. However, in the preferred embodiment, this material is a suitable elastomeric material. In one preferred embodiment, this material is a fluoroelastomeric material such as VITON®, commercially available from E. I. duPont de Nemours and Company in Wilmington, Del. It is to be understood that any suitable type and/or grade of VITON® may be used, however, in the preferred embodiment, a 60 durometer VITON® is used. Although less preferred, nitrile rubber may also be used to form O-ring 36. It is to be further understood that any mixtures of the above, composites, or any other suitable elastomeric, polymeric and/or natural materials may be used, depending upon the requirements/desires of the end user for the particular application.

Figure 6:
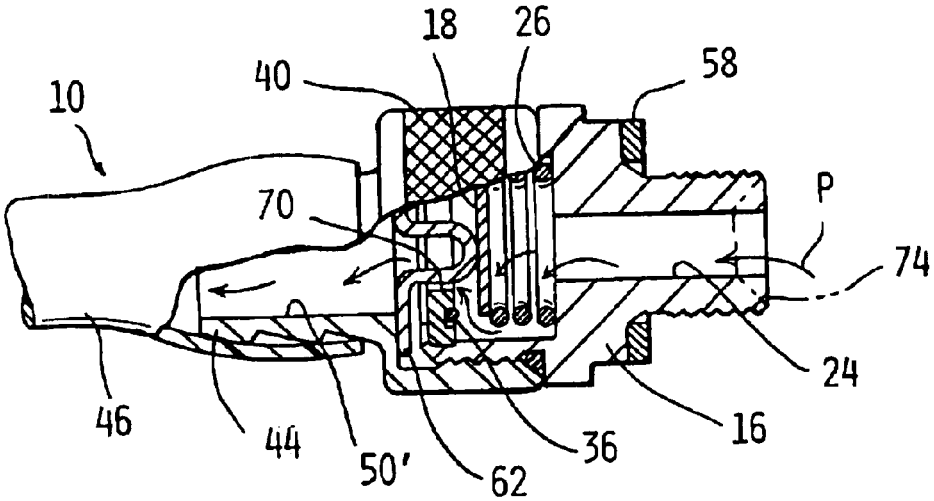
FIG. 6 is a partially cut-away cross-sectional view of the present invention showing the conduit adapter member engaged with the valve member and showing the fluid flow path.

It is to be understood that valve 18 may comprise any suitable valve. However, in the preferred embodiment, valve 18 is one of poppet valves, ball valves, flapper valves and ribbon valves. In a more preferred embodiment, valve 18 is a poppet valve as shown in FIG. 2. Poppet valve 18 is normally biased by spring 26 against the O-ring 36 in the valve seat 30 to the closed position (shown in FIG. 2; the open position is shown in FIG. 6). It is to be understood that the poppet valve as shown in FIG. 2 may be of any suitable diameter such that it forms a seal when biased against the valve seat 30. It is to be understood that the poppet valve 18 may be formed from any suitable material, for example, metallic materials and/or polymeric materials. In the preferred embodiment, poppet valve 18 is formed from stainless steel.

Without being bound to any theory, it is believed that a thin layer of oil between poppet valve 18 and O-ring 36 may substantially prevent O-ring 36 from inadvertently adhering to poppet 18 during opening of valve 18. If such inadvertent adhering did occur, there may be some potential that O-ring 36 may not return to O-ring groove 34, and in such a case, a sufficient seal between the valve 18 and valve seat 30 may not be formed when the valve 18 returns to the closed position.

Fluid drain assembly 10 further comprises a seal member 38 disposed on/circumscribing the other end region 22. Seal member 38 advantageously serves a dual purpose: it forms a seal between dust cap 54 and valve member 16 when dust cap 54 is attached thereto; or it forms a seal between conduit adapter member 40 and valve member 16 when adapter member 40 is attached thereto. This dual purpose seal member 38 aids in the manufacturing cost effectiveness of the present invention.

It is to be understood that seal member 38 may be one of O-rings, gaskets, seals, or any other suitable sealing device. As with the O-ring 36, seal member 38 may be formed from any suitable material. However, in the preferred embodiment, this material is a suitable elastomeric material. In one preferred embodiment, this material is a fluoroelastomeric material such as VITON®, commercially available from E. I. duPont de Nemours and Company in Wilmington, Del. It is to be understood that any suitable type and/or grade of VITON® may be used, however, in the preferred embodiment, a 70 durometer VITON® is used. Although less preferred, nitrile rubber may also be used to form O-ring 36. It is to be further understood that any mixtures of the above, composites, or any other suitable elastomeric, polymeric and/or natural materials may be used, depending upon the requirements/desires of the end user for the particular application.

It is to be understood that valve member 16 may be of any suitable size and/or shape. In a preferred embodiment, valve member 16 is substantially circular and ranges between about 0.75 inch (19 mm) and about 1.5 inch (38 mm) in length, without the dust cap 54 installed, i.e. from the end of the one end region 20 to the end of the other end region 22. In a further preferred embodiment, valve member 16 ranges between about 1.1 inch (28 mm) and about 1.2 inch (30 mm) in length, without the dust cap 54 installed. In a more preferred embodiment, valve member 16 is about 1.14 inch (29 mm) in length without the dust cap 54 installed. Installation of the dust cap 54 adds between about 0.1 inch (2.5 mm) and about 0.25 inch (6.4 mm) to the length of the valve member 16 in a preferred embodiment; however, in a more preferred embodiment, installation of the dust cap 54 adds about 0.14 inch (3.5 mm) to the length of the valve member 16 (i.e. in the more preferred embodiment, valve member 16 with the dust cap installed is about 1.28 inch (32 mm) in length). In a preferred embodiment, when valve member 16 is installed within sump wall 14 with the dust cap 54 installed, the length extending outwardly from sump 12 ranges between about 0.5 inch (13 mm) and about 1.3 inch (33 mm); in a further embodiment this length ranges between about 0.8 inch (20 mm) and about 0.9 inch (23 mm). In a more preferred embodiment, this length is about 0.87 inch (22 mm).

It is to be understood that the throughbore 24 and widened throughbore 24' may be of any suitable shape and size. However, in the preferred embodiment, these throughbores 24, 24' are each substantially circular in shape. In a preferred embodiment, the diameter of throughbore 24 ranges between about 0.1 inch (2.5 mm) and about 0.6 inch (15 mm). In a more preferred embodiment, the diameter of throughbore 24 ranges between about 0.25 inch (6.3 mm) and about 0.38 inch (9.6 mm). In a preferred embodiment, the diameter of throughbore 24' ranges between about 0.4 inch (10 mm) and about 0.8 inch (20 mm). In a more preferred embodiment, the diameter of throughbore 24' ranges between about 0.607 inch (15.4 mm) and about 0.615 inch (15.6 mm).

It is to be understood that the outer diameter of valve member 16 may be any suitable size. However, in a preferred embodiment, the outer diameter of valve member 16 measured at its widest point is about 0.875 inch (22 mm).

Figure 4:
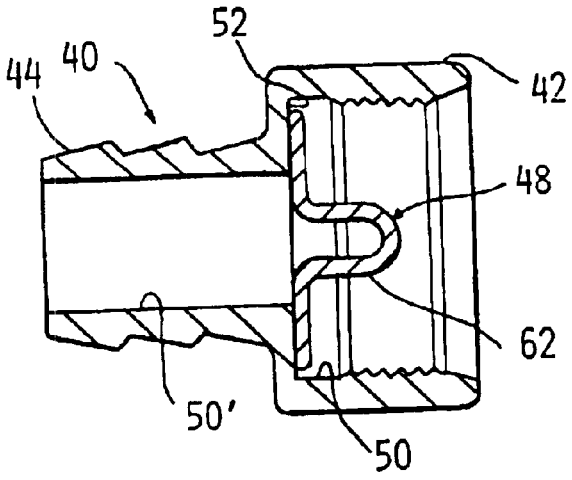
FIG. 4 is an enlarged cross-sectional side view of the conduit adapter member.

Fluid drain assembly 10 further comprises a conduit adapter member 40 removably engageable with the valve member 16 and adapted to be in fluid communication therewith. The conduit adapter member 40, as best seen in FIG. 4, comprises a valve member coupling portion 42 engageable with the valve member other end region 22. Conduit adapter member 40 further comprises a conduit coupling portion 44 opposed to the valve member coupling portion 42, and adapted to have a conduit 46 removably attached thereto. Conduit adapter member 40 may easily be installed in/removed from valve member 16 by hand.

It is preferred that the two coupling portions 42, 44 be unitarily formed as a one-piece structure. As such, this eliminates a joint between coupling portions 42, 44 and thus eliminates a potential leak path. Further, this obviates the need for a separate seal/gasket to cover such a joint.

A valve actuating member 48 is disposed within valve member coupling portion 42. Although valve actuating member 48 is shown as a pin in the drawings, it is to be understood that valve actuating member 48 may comprise a lever or any other suitable structure adapted to actuate the type of valve (poppet, ball, flapper, ribbon, etc.) chosen.

When the conduit adapter member 40 is engaged with the valve member 16, the conduit adapter member 40 seals against the seal member 38, and the valve actuating member 48 opens valve 18, thereby creating a fluid path P from the sump 12 through the valve member 16 and out the conduit adapter member 40. If the present invention is used to drain oil from, for example, an automobile, the fluid path P in FIG. 6 would be from the automobile's oil pan through the valve member throughbore 24, 24', past open valve 18, through the conduit adapter member 40 and into a suitable conduit 46 such as a hose suitable for carrying oil to an appropriate disposal region and/or disposal container. When the conduit adapter member 40 is disengaged from valve member 16, the valve 18 closes and substantially prevents fluid from flowing out of sump 12.

Referring back to FIG. 4, conduit adapter member 40 has a throughbore 50 extending longitudinally therethrough. The conduit adapter member throughbore 50 is in fluid communication with the valve member throughbore 24 when the conduit adapter member 40 is engaged with the valve member 16.

In a preferred embodiment, valve member coupling portion 42 is threadingly engageable with the valve member other end region 22. However, it is to be understood that valve member 16 may removably engage with conduit adapter member 40 by any suitable means, such as quick connectors, bayonet-style connectors, and the like.

The conduit adapter throughbore 50 narrows within the conduit coupling portion 44 to form a narrowed throughbore 50'. A shoulder area 52 of the conduit adapter member throughbore 50 defines a seat for the valve actuating member 48. The conduit adapter member shoulder area 52 is located at about a transition area between the valve member coupling portion 42 and the conduit coupling portion 44.

It is to be understood that conduit adapter member 40 may be of any suitable shape and/or size. However, in the preferred embodiment, the conduit adapter member 40 is substantially circular in shape and has a length ranging between about 0.75 inch (19 mm) and about 1.5 inch (38 mm) in length. In a further preferred embodiment, the conduit adapter member 40 has a length ranging between about 1.1 inch (28 mm) and about 1.2 inch (30 mm). In a more preferred embodiment, the conduit adapter member 40 has a length of about 1.14 inch (29 mm).

It is to be further understood that throughbores 50, 50' may be of any suitable size and shape, however, in the preferred embodiment, each of the throughbores 50, 50' are substantially circular in shape. In a preferred embodiment, the diameter of throughbore 50 ranges between about 0.6 inch (15 mm) and about 0.95 (24 mm) inch. In a more preferred embodiment, the diameter of throughbore 50 ranges between about 0.765 inch (19 mm) and about 0.785 inch (20 mm). In a preferred embodiment, the diameter of narrowed throughbore 50' ranges between about 0.25 inch (6 mm) and about 0.5 inch (13 mm). In a more preferred embodiment, the diameter of narrowed throughbore 50' is about 0.392 inch (10 mm).

In a preferred embodiment, the outer diameter of conduit adapter member 40 measured at its widest point ranges between about 0.71 inch (18 mm) and about 1.1 inch (28 mm). In a further preferred embodiment, the outer diameter of conduit adapter member 40 measured at its widest point ranges between about 0.84 inch (21 mm) and about 0.90 inch (23 mm). In a more preferred embodiment, this outer diameter is about 0.87 inch (22 mm).

Fluid drain assembly 10 may further comprise means, engageable with the valve member other end region 22, for protecting the valve member 16 from debris when the conduit adapter member 40 is disengaged therefrom. It is to be understood that this protecting means may comprise any suitable means, such as a cover, cap, or any other suitable device. Further, it is to be understood that the protecting means may be permanently attached to valve member 16 and may, for example, be rotated out of the way when the conduit adapter member 40 is in use. Yet further, the protecting means may be chained or removably fastened in any other suitable way to the valve member 16 or the sump 12 to prevent loss of the protecting means during sump drainage; or the protecting means may be completely separate from the valve member 16 and/or sump 12.

Figure 3:
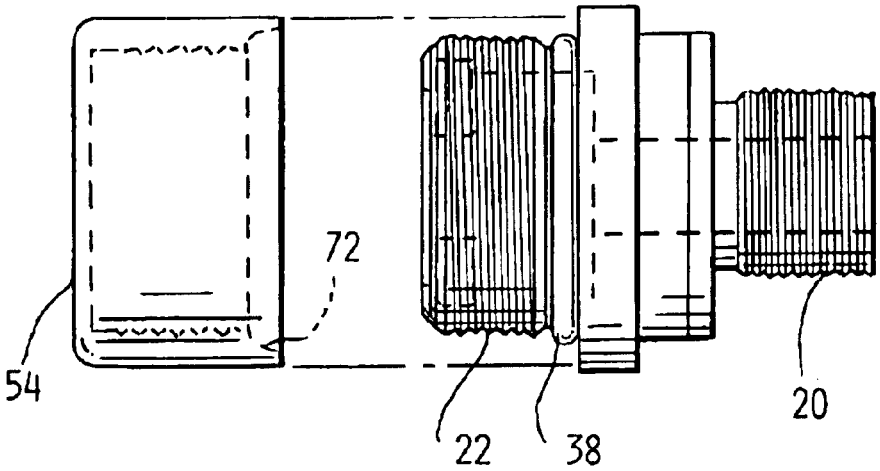
FIG. 3 is an exploded side view of the valve member with the dust cap removed.

In a preferred embodiment, this protecting means comprises a threaded dust cap 54, which is threadingly engageable with the valve member other end region 22, as seen in FIG. 3. As can best be seen in FIG. 2, when the dust cap 54 is engaged with the valve member other end region 22, the dust cap 54 seals against the seal member 38. Seal member 38 is under a low amount of compression when the dust cap 54 is installed. Dust cap 54 is designed to be installed and removed by hand, eg. lead angle 72 (FIG. 3) on the inner diameter of cap 54 acts to ease removal and installation of dust cap 54, as well as helping to minimize wear.

Figure 1B:
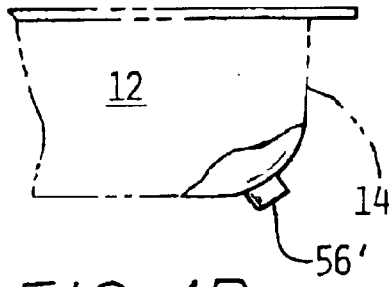
FIG. 1B is a cutaway side view showing a fluid sump with an alternate boss/nipple configuration, shown in phantom.

Referring yet to FIG. 2, the valve member one end region 20 is shown threadingly engaged within an internal boss 56 defined on sump wall 14. It is to be understood that boss 56 may be attached, formed on, welded to, molded in, or cast in wall 14 of sump 12, depending upon the material from which sump 12 is made and/or the requirements and/or desires of the particular end user for the desired application. Further, if wall 14 is suitably thick, a boss 56 would not be necessary, and the valve member 16 could simply engage within wall 14. An example in phantom of an external boss is shown at 56' in FIG. 1B. The structure at 56' in FIG. 1B may also comprise an externally threaded nipple extending outward from the sump 12. If this were the case, it is believed apparent that valve member one end region 20 would need to be internally threaded in order to be matingly engaged with an externally threaded nipple.

The fluid drain assembly 10 of the present invention may further comprise a washer 58 disposed between the valve member one end region 20 and the sump wall 14, as best seen in FIG. 2. It is to be understood that the washer 58 may also comprise any suitable washer, gasket, seal or the like. Washer 58 may be formed from any suitable metallic or non-metallic material. In the preferred embodiment, washer 58 comprises a crush washer. In a preferred embodiment, crush washer 58 is formed from copper, copper alloys, brass, or the like. However, it is to be understood that crush washer 58 may also be formed from any suitable metallic material and/or non-metallic material.

One advantage of the present invention is that the fluid drain assembly 10 may be transferred from one installation to another, eg. from one vehicle to another. If such a transfer were made, it may be desirable to replace crush washer 58.

Figure 7:
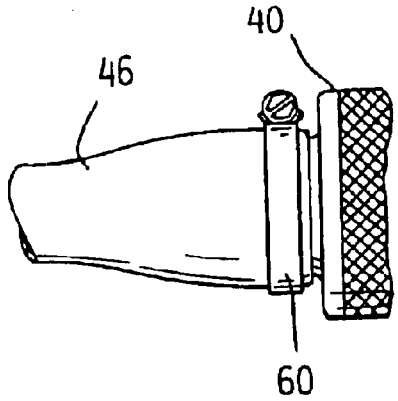
FIG. 7 is an enlarged cut-away side view showing an alternate means for attaching the conduit to the conduit adapter member.

Conduit coupling portion 44 may be formed from any suitable structure. In a preferred embodiment, conduit coupling portion 44 is a nipple adapted to receive a conduit 46 thereon. It is to be understood that the conduit coupling portion 44 comprising a nipple may be smooth, barbed (such as eg. the hose barb as shown in FIG. 4), threaded, with spaced raised protrusions, or the like. If a hose barb is to be used as the conduit coupling portion 44, it is to be understood that any suitable hose barb may be used. However, in the preferred embodiment, a standard hose barb is chosen for 0.5 inch (13 mm) (inner diameter) hose, with the widest area of the hose barb being about 0.58 inch (15 mm). As shown in FIG. 7, a hose clamp 60 may optionally be placed around the conduit 46.

Conduit adapter member 40 may be formed by any suitable method and from any suitable material, as desired and/or necessitated by a particular end use. Some examples of materials include, but are not limited to metals, metal alloys, powdered metals, and polymeric materials, including engineered plastics and the like. Non-limitative examples of some suitable methods include near net casting, multistage dies, etc. In the preferred embodiment, adapter member 40 is machined from solid brass bar stock. It 40 could also be cast or stamped using a die.

Figure 5B:
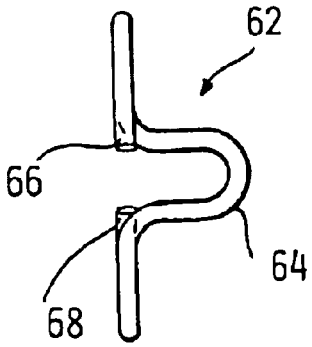
FIG. 5B is an enlarged side view of the valve actuating pin of the present invention.
Figure 5A:
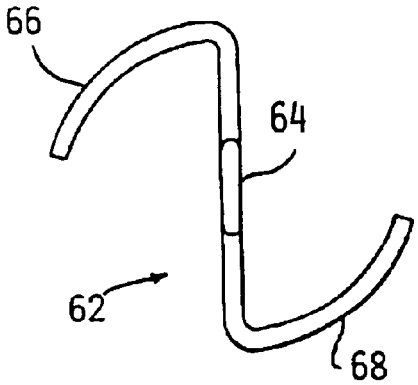
FIG. 5A is an enlarged top view of the valve actuating pin of the present invention.

It is to be understood that valve actuating member 48, as discussed above, may comprise any suitable structure. However, in the preferred embodiment, valve actuating member 48 comprises a pin member 62 as best seen in FIGS. 5A and 5B. The pin member 62 comprises means for positioning the pin member 62 within the valve member coupling portion 42 such that it contacts and opens the valve 18 when the conduit adapter member 40 is engaged with the valve member 16. The pin member 62 further comprises a pin 64 having an orientation, when the conduit adapter member 40 is engaged with the valve member 16, substantially parallel to an axis A running longitudinally through the valve member 16.

In the preferred embodiment, the positioning means comprises two opposed legs 66, 68 formed from a flexibly rigid material and adapted to be retained by spring tension within the valve member coupling portion 42. Pin 64 is formed from the flexibly rigid material, is integral with the legs 66, 68, and extends substantially perpendicularly and outwardly from the legs (see FIG. 5B). It is to be understood that there may only be one leg 66, more than two legs 66, 68, or legs 66, 68 may actually form an entire, substantially entire, and/or partial circular member.

The orientation of pin 64 described above is desirable in that with the pin 64 having this orientation, deeper penetration is available through a relatively smaller aperture 70, as compared with a pin having angled sides, i.e. the fluid drain assembly 10 may be formed in a more compact and smaller package and yet have successful actuation of the valve 18. It is to be understood that pin member 62 may be formed by any suitable method, however, in the preferred embodiment, a progressive die is used.

It is to be understood that the flexibly rigid material may be formed from any material suitable to remain in place and also serve to successfully actuate valve 18 when conduit adapter member 40 is engaged with valve member 16. However, in the preferred embodiment, the flexibly rigid material is music wire. It is to be understood that this wire may have any suitable diameter, however in the preferred embodiment, the diameter of the music wire ranges between about ¾ mm to about 2 mm. In a more preferred embodiment, the music wire has a diameter of about 1 mm (0.039 in). In a further preferred embodiment, the music wire has a diameter of 1.06 mm (0.042 in).

Referring again to FIG. 6, an optional funnel structure/feature 74 (shown in phantom) may define the inlet end of the one end region 20. If the inlet is modified to form funnel structure 74, the portion of the inlet shown in cross sectional solid line to the right of the phantom line 74 (representing the funnel structure) in the drawing would be removed (or the valve member 16 would be formed at the outset with the funnel-shaped inlet). Funnel structure 74 may advantageously aid in increasing the flow rate of the fluid as it flows through the fluid path P.

The fluid drain assembly 10 of the present invention may be provided as an OEM part, but it is believed that it may find most use in after market applications. The fluid drain assembly 10 presents many advantages, as may be gleaned from the present disclosure. The present invention may last for several years of oil changes, depending upon several factors, eg. storage conditions of conduit adapter member 40 between oil changes, etc. The present invention is a novel, tool-free (a tool(s) may be desired to replace the original drain plug with the valve member 16), easier way to change fluid/oil in, eg. an automobile with substantially no mess and substantially no hot fluids/oil to deal with. The conduit adapter member 40 with attachable conduit 46 is designed for fast, easy, twist-on operation, thereby starting the flow of fluid/oil directly into a receptacle with the turn of a wrist. The dust cap 54 helps to keep valve member 16 free from (in the case of automotive use) road dirt and safe from undercarriage debris, locking firmly into place until the next oil change. Dust cap 54 is substantially leak free, corrosion resistant, and resistant to vibration and road damage.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A fluid drain assembly for attachment to a fluid sump having a wall, the drain assembly comprising:

a valve member being configured to provide fluid communication with the sump, the valve member having a normally closed valve therein, and further having two opposed end regions, one end region adjacent the sump and an other end region distal from the sump;

a seal member disposed on the other end region; and a conduit adapter member removably engageable with the valve member and adapted to be in fluid communication therewith, the conduit adapter member comprising:

a valve member coupling portion engageable with the valve member other end region;

a conduit coupling portion opposed to the valve member coupling portion, and adapted to have a conduit removably attached thereto, the two coupling portions being unitarily formed as a one piece structure; and a valve actuating pin member disposed within the valve member coupling portion, wherein the valve actuating pin member comprises:

two opposed legs formed from a flexibly rigid material and adapted to be retained by spring tension within the valve member coupling portion, and a pin formed from the flexibly rigid material, the pin extends substantially perpendicularly and outwardly from the legs, and wherein when the conduit adapter member is engaged with the valve member, the conduit adapter member seals against the seal member, and the pin opens the valve, thereby creating a fluid path from the sump through the valve member and out the conduit adapter member;

and wherein when the conduit adapter member is disengaged from the valve member, the valve closes and substantially prevents fluid from flowing out of the sump.

2. The fluid drain assembly as defined in claim 1, further comprising means, engageable with the valve member other end region, for protecting the valve member from debris when the conduit adapter member is disengaged therefrom.

3. The fluid drain assembly as defined in claim 1, wherein the valve member one end region is threadingly engaged with the sump all, and wherein the valve member coupling portion is threadingly engaged with the valve member other end region.

4. The fluid drain assembly as defined in claim 3, further comprising means, threadingly engageable with the valve member other end region, for protecting the valve member from debris when the conduit adapter member is disengaged therefrom, wherein when the protecting means is engaged with the valve member other end region, the protecting means seals against the seal member.

5. The fluid drain assembly as defined in claim 1, wherein the fluid sump contains oil adapted for use with an internal combustion engine.

6. The fluid drain assembly as defined in claim 1, wherein the valve is one of poppet valves, ball valves, flapper valves, and ribbon valves.

7. The fluid drain assembly as defined in claim 1, wherein the seal member is one of O-rings, gaskets, and seals.

8. The fluid drain assembly as defined in claim 7 wherein the seal member is formed from an elastomeric material.

9. The fluid drain assembly as defined in claim 8 wherein the elastomeric material is selected from fluoroelastomeric materials.

10. The fluid drain assembly as defined in claim 8 wherein the elastomeric material is selected from nitrile rubbers.

11. The fluid drain assembly as defined in claim 5 wherein the conduit comprises tubing adapted to carry the oil therewithin.

12. The fluid drain assembly as defined in claim 1, further comprising a crush washer disposed between the valve member one end region and the sump wall.

13. The fluid drain assembly as defined in claim 12 wherein the crush washer is formed from copper.

14. The fluid drain assembly as defined in claim 1, wherein die conduit coupling portion is a nipple adapted to receive a conduit thereon, and wherein the conduit is adapted to receive a hose clamp therearound.

15. The fluid drain assembly as defined in claim 1, wherein die conduit coupling portion is a hose barb.

16. The fluid drain assembly as defined in claim 1 wherein the flexibly rigid material is music wire.

17. The fluid drain assembly as defined in claim 16 wherein the music wire has a diameter of about 1 mm (0.039 inch).

18. An automotive oil drain assembly for attachment to an oil sump having a wall, the drain assembly comprising:

a valve member having a throughbore extending longitudinally therethrough, the throughbore adapted to be in fluid communication with the sump, the valve member comprising:

two opposed externally threaded end regions, one end region adjacent the sump and an other end region distal from the sump, wherein the throughbore widens within the other end region;

a spring disposed within the widened throughbore;

a shoulder area of the throughbore defining a stop for the spring, the shoulder area located at about a transition area between the one end region and the other end region;

a valve seat disposed at an end of the widened throughbore opposed to the spring stop, the valve seat having an O-ring groove defined therein;

an O-ring disposed within the O-ring groove;

a valve disposed within the widened throughbore, wherein the valve is normally biased by the spring against the O-ring in the valve seat to the closed position:

a seal member disposed on the other end region; and a conduit adapter member having a throughbore extending longitudinally therethrough, the conduit adapter member being removably engageable with the valve member, wherein the conduit adapter member throughbore is in fluid communication with the valve member throughbore when the conduit adapter member is engaged with the valve member, the conduit adapter member comprising:

a valve member coupling portion threadingly engageable with the valve member other end region;

a conduit coupling portion opposed to the valve member coupling portion, and adapted to have a conduit removably attached thereto, the two coupling portions being unitarily formed as a one piece structure, wherein the conduit adapter throughbore narrows within the conduit coupling portion;

a valve actuating member disposed within the valve member coupling portion; and a shoulder area of the conduit adapter member throughbore defining a seat for the valve actuating member, the conduit adapter member shoulder area located at about a transition area between the valve member coupling portion and the conduit coupling portion;

wherein when the conduit adapter member is engaged with the valve member, the conduit adapter member seals against the seal member, and the valve actuating member opens the valve, thereby creating a fluid path from the sump through the valve member and out the conduit adapter member;

and wherein when the conduit adapter member is disengaged from the valve member, the valve closes and substantially prevents fluid from flowing out of the sump and wherein the valve actuating member is a pin formed from a flexibly rigid material, the pin having two opposed legs extending substantially perpendicularly and outwardly therefrom, the legs adapted to be retained by spring tension within the valve member coupling portion, wherein the legs position the pin within the valve member coupling portion such that the pin contacts and opens the valve when the conduit adapter member is engaged with the valve member.

19. The automotive oil drain assembly as defined in claim 18, further comprising a dust cap, threadingly engageable with the valve member other end region, for protecting the valve member from debris when the conduit adapter member is disengaged therefrom, wherein when the dust cap is engaged with the valve member other end region, the dust cap seals against the seal member.

20. The automotive oil drain assembly as defined in claim 18, wherein the valve is one of poppet valves, ball valves, flapper valves, and ribbon valves.

21. The automotive oil drain assembly as defined in claim 18, wherein the seal member is one of O-rings, gaskets, and seals.

22. The automotive oil drain assembly as defined in claim 21 wherein the seal member is formed from an elastomeric material selected from at least one of fluoroelastomeric materials, nitrile rubbers, and mixtures thereof.

23. The automotive oil drain assembly as defined in claim 18, further comprising a crush washer disposed between the valve member one end region and the sump wall, wherein the crush washer is formed from copper.

24. The automotive oil drain assembly as defined in claim 18, wherein the conduit coupling portion is a nipple adapted to receive a conduit thereon, and wherein the conduit is adapted to receive a hose clamp therearound.

25. The automotive oil drain assembly as defined in claim 18, wherein the conduit coupling portion is a hose barb.

26. The automotive oil drain assembly as defined in claim 18 wherein the flexibly rigid material is music wire.

27. The automotive oil drain assembly as defined in claim 26 wherein the music wire has a diameter of about 1 mm (0.039 inch).

28. The fluid drain assembly as defined in claim 1, wherein the valve member has an inlet in the one end region, and wherein a funnel structure defines the inlet.

29. The automotive oil drain assembly as defined in claim 18, wherein the valve member has an inlet in the one end region, and wherein a funnel structure defines the inlet.

30. A drain assembly for a fluid containing vessel, comprising:

a valve member having a throughbore extending therethrough, the valve member being configured to be in fluid communication with the fluid containing vessel;

a spring actuated valve member disposed within the throughbore of the valve member;

a conduit adapter member having a throughbore extending therethrough, the conduit adapter member being configured to removably engage the valve member; and a valve actuating member disposed within the conduit adapter member, said valve actuating member comprising; a flexibly rigid material having two leg potions being configured to be retained within the conduit adapter member and a pin portion, the pin portion protruding away from the leg portions such that the pin contacts and opens the valve when the conduit adapter member is engaged with the valve member, thereby creating a fluid path from the fluid containing vessel through the valve member and the conduit adapter member and when the conduit adapter member is disengaged from the valve member, the valve closes and substantially prevents fluid from flowing out of the fluid containing vessel.

31. The drain assembly as in claim 30, wherein the valve member is threaded at either end and the conduit adapter member is configured to engage one of the threaded ends of the valve member.

32. The drain assembly as in claim 31, further comprising a cap configured to engage the one of the threaded ends of the valve member.

33. The drain assembly as in claim 32, further comprising a sealing member disposed proximate to the threaded ends of the valve member.

34. The drain assembly as in claim 33, wherein one of the sealing members provides a seal between the cap and the valve body when the cap engages a threaded end of the valve body.

35. The drain assembly as in claim 34, wherein the sealing members are O-rings.

36. The drain assembly as in claim 33, wherein one of the sealing members provides a seal between the conduit adapter member and the valve body when the conduit adapter member engages a threaded end of the valve body.

37. The drain assembly as in claim 33, wherein the sealing members are O-rings.

38. The drain assembly as in claim 33, wherein one of the sealing members provides a seal between the valve body and the fluid containing vessel.

39. The drain assembly as in claim 30, wherein the valve member is one of poppet valves, ball valves, flapper valves, and ribbon valves.

40. The drain assembly as in claim 30, wherein the conduit adapter member comprises a nipple configured to receive a conduit thereon.

41. The drain assembly as in claim 30, wherein the flexibly rigid material is music wire.

* * * * *